US009172171B2

(12) United States Patent
Nemoto

(10) Patent No.: US 9,172,171 B2
(45) Date of Patent: Oct. 27, 2015

(54) CONNECTOR HOUSING WITH FIXED ENDED LANCE AND REMOVAL JIG FOR THE SAME

(75) Inventor: Shin Nemoto, Makinohara (JP)

(73) Assignee: Yazaki Corporation, Tokyo (JP)

( * ) Notice: Subject to any disclaimer, the term of this patent is extended or adjusted under 35 U.S.C. 154(b) by 135 days.

(21) Appl. No.: 14/007,761

(22) PCT Filed: Mar. 30, 2012

(86) PCT No.: PCT/JP2012/059432

§ 371 (c)(1),
(2), (4) Date: Sep. 26, 2013

(87) PCT Pub. No.: WO2012/133949

PCT Pub. Date: Oct. 4, 2012

(65) Prior Publication Data

US 2014/0017958 A1 Jan. 16, 2014

(30) Foreign Application Priority Data

Mar. 30, 2011 (JP) ..... 2011-075927

(51) Int. Cl.

| | |
|---|---|
| ***H01R 13/40*** | (2006.01) |
| ***H01R 13/424*** | (2006.01) |
| ***H01R 13/422*** | (2006.01) |
| *H01R 43/22* | (2006.01) |

(52) U.S. Cl.

CPC ..... *H01R 13/424* (2013.01); *H01R 13/4223* (2013.01); *H01R 43/22* (2013.10)

(58) Field of Classification Search

USPC ..... 439/595, 744
IPC ..... H01R 13/4223,13/4365, 13/4364, 13/426, H01R 13/434

See application file for complete search history.

(56) References Cited

U.S. PATENT DOCUMENTS

| | | | | |
|---|---|---|---|---|
| 6,524,133 | B2 * | 2/2003 | Murakami | 439/595 |
| 6,764,335 | B2 * | 7/2004 | Ichio | 439/595 |
| 6,817,900 | B2 * | 11/2004 | Yamawaki et al. | 439/595 |
| 6,939,171 | B2 * | 9/2005 | Fukatsu et al. | 439/595 |

(Continued)

FOREIGN PATENT DOCUMENTS

| | | | |
|---|---|---|---|
| CN | 1466243 | A | 1/2004 |
| CN | 1612420 | A | 5/2005 |
| JP | 2003-45544 | A | 2/2003 |

OTHER PUBLICATIONS

Office Action dated Nov. 12, 2014 issued by the Japanese Patent Office in counterpart Japanese Patent Application No. 2011-075927.
International Search Report (PCT/ISA/210), dated Jul. 3, 2012, issued by the International Searching Authority in counterpart International Patent Application No. PCT/JP2012/059432.
Written Opinion (PCT/ISA/237), dated Jul. 3, 2012, issued by the International Searching Authority in counterpart International Patent Application No. PCT/JP2012/059432.
Office Action dated Apr. 28, 2015, issued by the State Intellectual Property Office of P.R. China in counterpart Chinese Application No. 201280016598.2.

*Primary Examiner* — Hien Vu
(74) *Attorney, Agent, or Firm* — Sughrue Mion, PLLC

(57) ABSTRACT

A connector housing includes a terminal accommodating chamber, a lance and a pair of arms. The terminal accommodating chamber is formed with an opening configured such that a terminal is inserted therethrough. The lance extends from a top wall of the terminal accommodating chamber toward the opening in an extending direction. The pair of arms are respectively formed integrally to both lateral side surfaces of the lance, extend from both the lateral side surfaces to front and back sides of the lance in the extending direction, and are connected to a bottom wall of the terminal accommodating chamber. An unlocking protrusion is formed in one of the arms.

7 Claims, 12 Drawing Sheets

(56) References Cited

U.S. PATENT DOCUMENTS

| | | | |
|---|---|---|---|
| 2001/0003076 | A1 | 6/2001 | Kodama |
| 2003/0027455 | A1 | 2/2003 | Yamawaki et al. |
| 2003/0157834 | A1 | 8/2003 | Ichio |
| 2004/0005821 | A1 | 1/2004 | Nankou et al. |
| 2005/0095909 | A1 | 5/2005 | Fukatsu |

* cited by examiner

CONNECTOR HOUSING WITH FIXED ENDED LANCE AND REMOVAL JIG FOR THE SAME

TECHNICAL FIELD

The present invention is related to a connector housing in which a fixed ended lance is formed, and a removal jig for the connector housing. In this description, the "fixed ended lance" indicates a lance in which both ends thereof are fixed.

BACKGROUND ART

A connector housing in which a fixed ended lance is formed is publicly known (see PTL1).

In PTL1, a part of a partition wall constructing terminal accommodating space of a connector housing is combined with a front half of a flexible lance, and a back half of the lance which intersects with the front half is formed obliquely, and a terminal locking surface is arranged in a longitudinal center of the lance at a front end of the back half. A pair of front halves of the lance is disposed oppositely and the terminal locking surface is positioned over the whole width of the terminal accommodating space between the pair of front halves, and a longitudinal center of a side part of the lance is provided with a projection which is an unlocking part for press-contacting the distal end of a jig bar. That is, according to PTL1, in order to maintain a high lance locking force while miniaturizing a connector, an arm part extending from the lance toward the front and connecting to the front of a cavity is had and both right and left sides of the lance are provided with projections for unlocking in order to unlock a terminal, so that the terminal is unlocked by pushing up the projections with the jig bar and the terminal can be removed.

According to the PTL1, the front half of the lance is integrated with the partition wall and is combined with a part of the partition wall, so that a long lance can be obtained without requiring large space and this space saving miniaturizes the connector housing and also, the lance tends to flex and terminal insertability improves. Also, a front end face of the back half of the lance is combined with the terminal locking surface and thereby, a locking protrusion is not required and the connector housing is miniaturized by the dimension of protrusion height of the locking protrusion and also, the terminal is directly locked in a front end face of the arm back half without using the locking protrusion and thereby, a reliability of locking can be improved.

CITATION LIST

Patent Literature

[PTL1] JP-A-2003-45544

SUMMARY OF INVENTION

Technical Problem

When miniaturization of the connector advanced and a pitch between cavities became narrow, it became difficult to provide both right and left sides of the lance with the projections for unlocking as shown in the structure described above. That is, a decrease in space in the right and left directions caused a thin-walled metallic mold so as not to withstand a resin injection pressure at the time of molding or a thin-walled shape so as to be impossible to be molded by injection molding.

It is therefore one advantageous aspect of the present invention to provide a connector housing capable of increasing a lance locking force and having a cavity shape capable of holding even at a narrow pitch.

Solution to Problem

According to one advantage of the invention, there is provided a connector housing, comprising:

a terminal accommodating chamber, formed with an opening configured such that a terminal is inserted therethrough;

a lance, extending from a top wall of the terminal accommodating chamber toward the opening in an extending direction; and a pair of arms, respectively formed integrally to both lateral side surfaces of the lance, extending from both the lateral side surfaces to front and back sides of the lance in the extending direction, and connected to a bottom wall of the terminal accommodating chamber, wherein an unlocking protrusion is formed in one of the arms.

One of the arms may be different from the other one of the arms in at least one of length, thickness and width, so that a reaction force of the one of the arms which is provided with the unlocking protrusion is stronger than a reaction force of the other one of the arms.

According to another advantage of the invention, there is provided a removal jig for removing the terminal inserted into the connector housing. The removal jig comprises: an insertion part having a length ranging from the opening to the unlocking protrusion; and a grip part coupled integrally to the insertion part.

Advantageous Effects of Invention

According to the configuration of the present invention, the lance is formed in fixed ended, so that a locking force of the terminal can be increased.

One of the unlocking protrusions formed in both sides of the lance is eliminated, so that the invention has a pitch narrower than that of a conventional product and miniaturization of the connector advances.

A reaction force of one of the right and left arms of both sides of the lance is weakened, so that the lance can be lifted in good balance even for only one unlocking protrusion.

The removal jig has a simple shape, so that the robust removal jig is obtained at low cost.

DESCRIPTION OF EMBODIMENTS

An embodiment according to the invention will hereinafter be described based on FIGS. 1A to 2D.

Figure 1A:
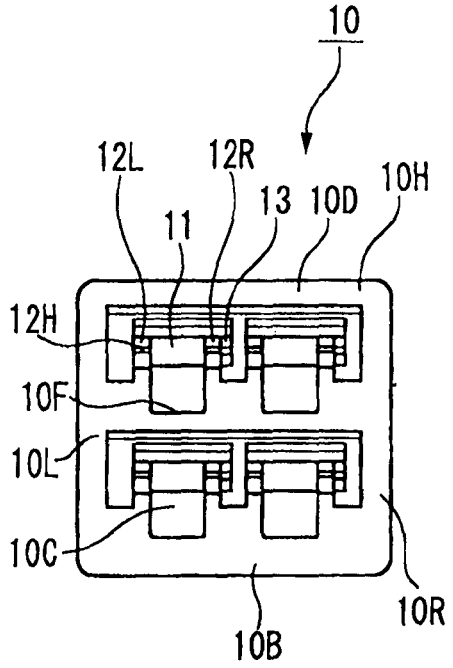
FIG. 1A is a front view of a connector housing (female housing) according to an embodiment of the invention.
Figure 1B:
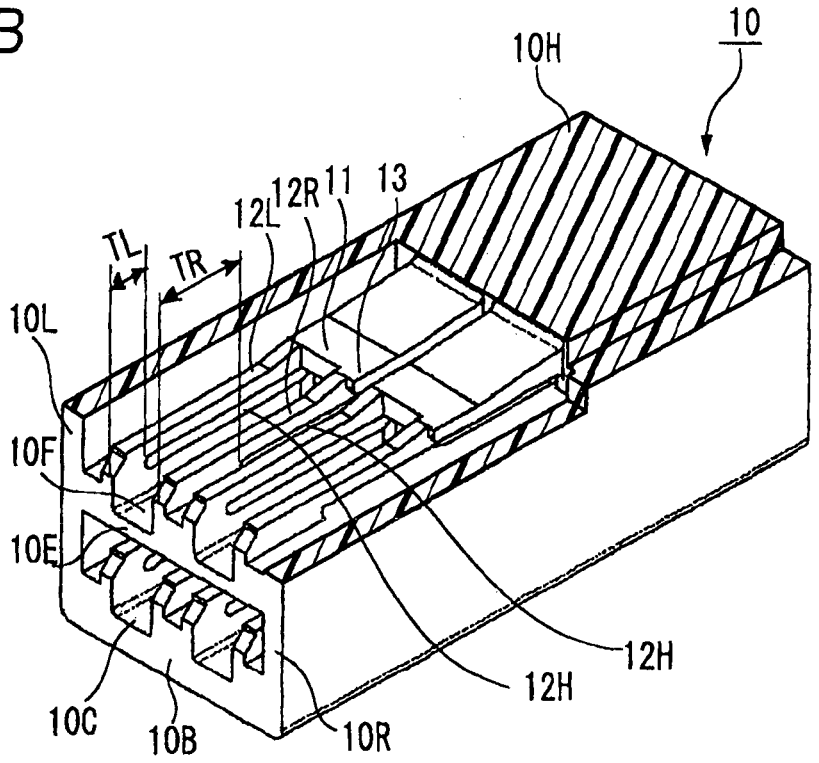
FIG. 1B is a transverse sectional perspective view of the connector housing.
Figure 1C:
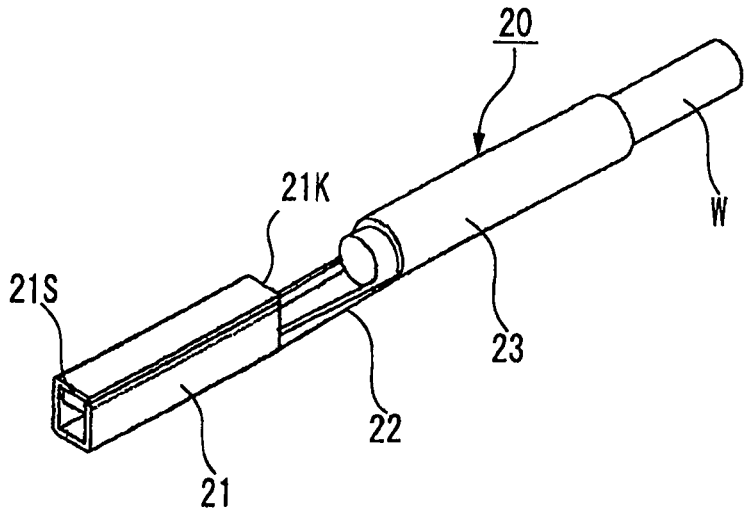
FIG. 1C is a perspective view of a publicly known terminal (female terminal) according to the embodiment.
Figure 1D:
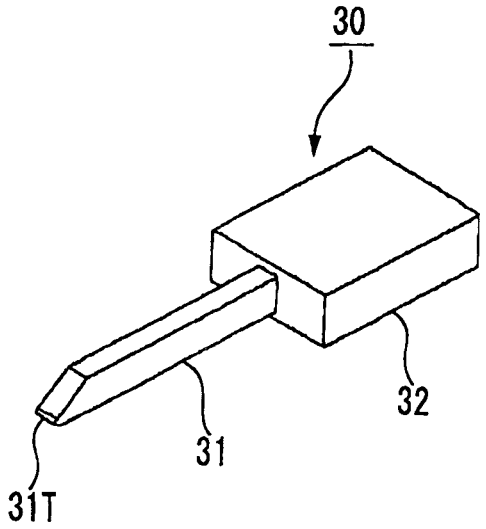
FIG. 1D is a perspective view of a removal jig according to the embodiment.
Figure 2B:
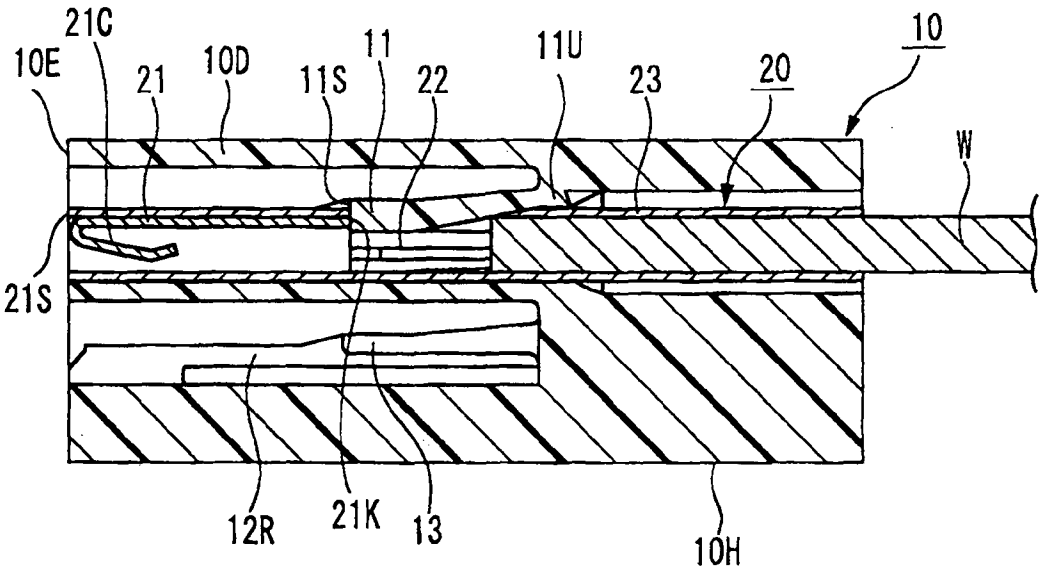
FIG. 2B is a sectional view taken on arrow line A-A of FIG. 2A.
Figure 2A:
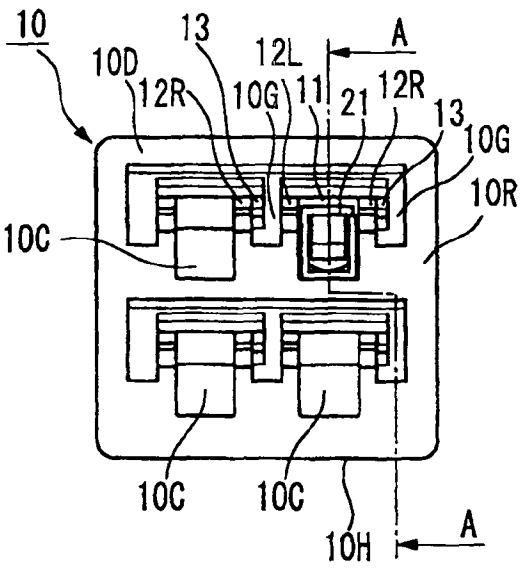
FIG. 2A is a front view showing a state of inserting the terminal into a top-right terminal accommodating chamber of four terminal accommodating chambers present in the left, right, top and bottom of the connector housing of FIG. 1A.
Figure 2D:
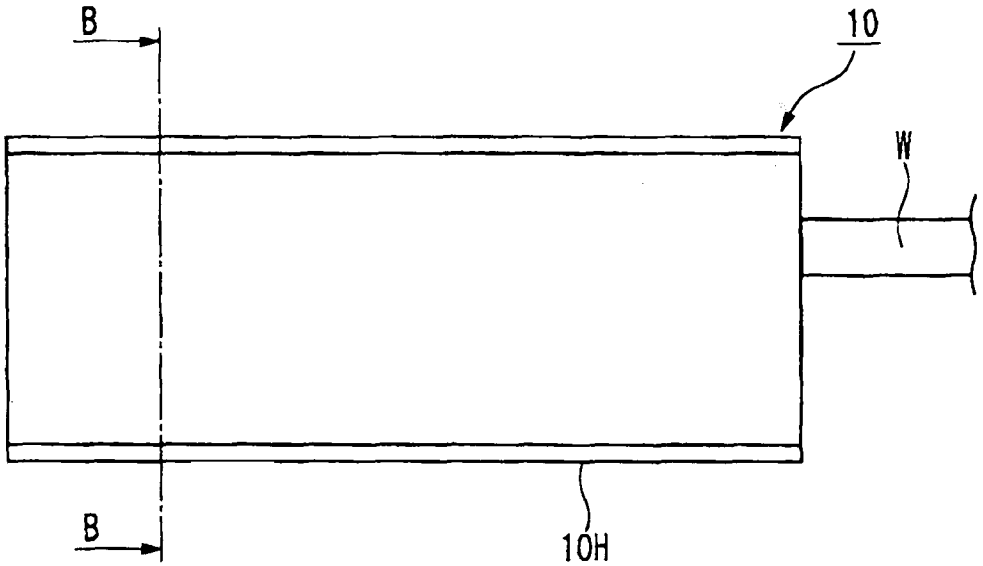
FIG. 2D is a side view of the connector housing of FIG. 2B.
Figure 2C:
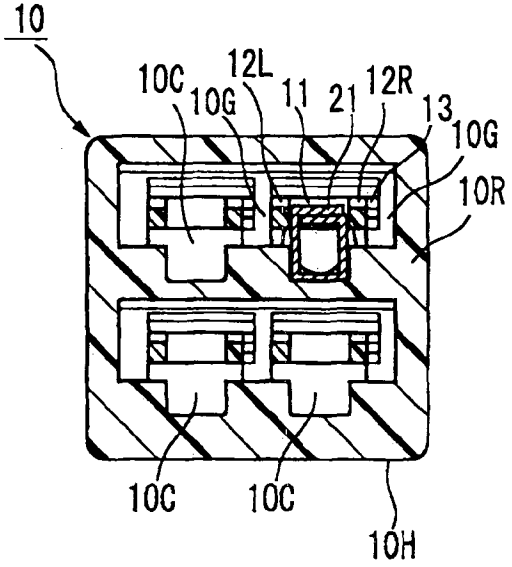
FIG. 2C is a sectional view taken on arrow line B-B of FIG. 2D.

FIG. 1A is a front view of a connector housing, and FIG. 1B is a transverse sectional perspective view of the connector housing, and FIG. 1C is a perspective view of a terminal, and FIG. 1D is a perspective view of a removal jig, and FIG. 2A is a front view showing a state of inserting the terminal into a top-right terminal accommodating chamber of four terminal accommodating chambers present in the left, right, top and bottom of the connector housing of FIG. 1A, and FIG. 2B is a sectional view taken on arrow line A-A of FIG. 2A, and FIG. 2D is a side view of the connector housing of FIG. 2B, and FIG. 2C is a sectional view taken on arrow line B-B of FIG. 2D.

In FIGS. 1A to 2D, a terminal 20 is received in a terminal accommodating chamber 100 of the inside of a housing body 10H of a connector housing 10 to be used as a connector.

Then, when it is necessary to remove the terminal 20 received in the terminal accommodating chamber 10C from the terminal accommodating chamber 10C, the terminal 20 is removed using a removal jig 30 according to the invention.

Hence, the connector housing 10 according to the invention, the publicly known terminal 20 and the removal jig 30 according to the invention will hereinafter be described in this order.

The connector housing 10 in FIGS. 1A to 2D includes the housing body 10H of resin molding made of a roof 10D (a top wall), a bottom 10B (a bottom wall) and left and right side walls 10L, 10R connecting both of the roof and the bottom, and a lock arm which is formed on the upper outside of this housing body 10H and engages with the other connector housing. The lock arm is omitted in the drawings since the lock arm does not relate to the invention directly. The housing body 10H has the terminal accommodating chambers 10C by a required number in a length direction. The number of the terminal accommodating chambers is four in the left, right, top and bottom in the drawings, in this embodiment.

FIG. 1B is a transverse section in which the roof 10D of the housing body 10H of FIG. 1A is further eliminated, and the insides of the two terminal accommodating chambers 10C of the top step are seen. In FIGS. 1A and 1B, the housing body 10H has a rectangular parallelepiped molded by synthetic resin, and the following terminal accommodating chambers 10C made of passages extending through a length direction (terminal insertion direction) of the housing body 10H are formed.

A total of four terminal accommodating chambers 10C of two right and left chambers on the first floor and two right and left chambers on the second floor are formed in the housing body 10H in FIGS. 1A and 1B. The inside of the terminal accommodating chamber 10C (FIG. 1A) includes a bottom 10F, left and right side walls vertically erected from both left and right ends of the bottom 10F, and a roof 10D for mutually joining the tops of the left and right side walls. The side walls include a left arm 12L and a right arm 12R. The both ends intersect with the terminal insertion direction. A lance 11 according to the invention is formed in this terminal accommodating chamber 10C as described below.

FIG. 2A is a front view showing a state of inserting the terminal into a top-right terminal accommodating chamber of four terminal accommodating chambers present in the left, right, top and bottom of the connector housing of FIG. 1A, and FIG. 2B is a sectional view taken on arrow line A-A of FIG. 2A, and FIG. 2D is a side view of the connector housing of FIG. 2B, and FIG. 2C is a sectional view taken on arrow line B-B of FIG. 2D.

In FIGS. 2A and 2B, an overhanging part 11U vertically overhangs from the middle of a length direction of the roof 10D to the side of the terminal accommodating chamber 100, and the lance 11 which extends slightly obliquely from the distal end of its overhanging part 11U toward an entrance 10E (an opening) of the terminal accommodating chamber 100 for inserting the other terminal and horizontally extends from the middle is formed. A distance between the entrance 10E (see FIG. 2B) and the distal end 11S (see FIG. 2B) of the lance 11 is equal to a length between the distal end 21S and the locking end 21K (see FIGS. 1C, 1D and 2B) in the back end of a box part 21 (see FIGS. 1C, 1D and 2B) of the inserted terminal 20.

Also, by an elastic force had by a resin material used, when the terminal 20 is inserted, the lance 11 retracts to the side of the roof 10D of the terminal accommodating chamber 10C and allows the box part 21 of the terminal 20 to pass and after the passage of the box part 21, the lance 11 returns to a normal state by a restoring force. At the time of returning to the normal state, the distal end 11S of the lance 11 engages with the locking end 21K of the back end of the box part 21 of the terminal 20.

The left and right of the lance 11 are respectively integrated with the left arm 12L of the left side wall and the right arm 12R of the right side wall, and the left arm 12L and the right arm 12R are constructed so that elongated long holes 12H horizontally extending from the vicinity of the entrance side to the vicinity just under the overhanging part 11U of the lance 11 are respectively bored in the left side wall and the right side wall of the terminal accommodating chamber 10C and thereby the upper wall parts of the long holes 12H form the arms. Thus, the left and right sides of the lance 11 are respectively formed integrally to the left and right arms 12L, 12R in the middles of the left and right arms 12L, 12R, so that the lance 11 is formed in fixed ended structurally, and has a stronger reaction force in a flexure direction than that of cantilever support, and has a good terminal locking force. Therefore, the terminal becomes resistant to coming out of the housing body 10H. The left and right arms 12L, 12R are respectively formed integrally to both of the left and right sides of the lance 11, extend from both of the left and right sides of the lance 11 to front and back sides of the lance 11 in an extending direction thereof, and are connected to the bottom 10F of the terminal accommodating chamber 10C.

Removal jig insertion spaces 10G are respectively formed between a right side surface 10R of the housing body 10H and the right arm 12R of the lance 11 in the right terminal accommodating chamber 10C, and between the left arm 12L of the right lance 11 and the right arm 12R of the lance 11 in the left terminal accommodating chamber 10C. Then, an unlocking protrusion 13 according to the invention projects from the right arm 12R in the vicinity of the distal end 11S of each of the lances 11 toward the removal jig insertion space 10G. When this unlocking protrusion 13 is lifted by the removal jig 30 described below, the lance 11 integrated with the unlocking protrusion 13 is together lifted.

A horizontal length of the long hole 12H bored in the left arm 12L is not equal to a horizontal length of the long hole 12H bored in the right arm 12R. According to the invention, the length of the long hole 12H of the right arm 12R of the side in which the unlocking protrusion 13 is formed is shorter than the length of the long hole 12H of the left arm 12L of the opposite side. That is, when a distance from the entrance 10E of the terminal accommodating chamber 10C to the end of the long hole 12H bored in the left arm 12L is set at TL and a distance from the entrance 10E of the terminal accommodating chamber 10C to the end of the long hole 12H bored in the right arm 12R is set at TR in FIG. 1B, TL<TR is satisfied as is evident from the drawing.

Consequently, a reaction force of the opposite left arm 12L becomes weaker than a reaction force of the right arm 12R of the unlocking protrusion side and when the unlocking protrusion 13 is lifted by the removal jig 30 and the right arm 12R integrated with this unlocking protrusion 13 is lifted and displaced, the opposite left arm 12L with the weaker reaction force also follows this right arm 12R and is displaced, so that the whole lance 11 is lifted in good balance.

Therefore, according to the invention, one unlocking protrusion per terminal accommodating chamber can be omitted as compared with the connector housing of PTL1 in which both sides of the lance 11 are provided with the unlocking protrusions, so that a width direction of the connector can be miniaturized.

In the embodiment described above, the right arm 12R is provided with the unlocking protrusion 13, but the invention is not limited to this, and the left arm 12L may naturally be provided with the unlocking protrusion 13.

In the above, the reaction force of the opposite arm is weakened by making the length of the long hole of the opposite arm longer than the length of the long hole of the arm side in which the unlocking protrusion 13 is formed, and instead of this, a vertical thickness of the opposite arm may be decreased to weaken the reaction force of the opposite arm by making the height of the long hole of the opposite arm higher than the height of the long hole of the side in which the unlocking protrusion is formed.

Also, the reaction force of the opposite arm may be weakened by making the transverse width of the opposite arm narrower than the transverse width of the arm of the side in which the unlocking protrusion is formed.

FIG. 1C is a perspective view of the terminal 20.

The terminal 20 is a publicly known terminal, and is manufactured by press molding of a conductive metal plate, and is configured to include the box part 21, a joint 22 connected to the box part 21, and an electric wire crimp part 23 connected to the joint 22 from the distal end of an insertion direction.

The box part 21 is a long body with substantially a square frame shape in cross section view, and an electrical contact piece 21C integrated with the box part 21 is arranged in internal space of the square frame shaped box part 21 of the long body, and when the other male terminal is inserted into the square frame shaped internal space, the other male terminal makes contact with this electrical contact piece 21C (FIG. 2B) to complete electrical connection between the other male connector and the connector housing 10. The length from the entrance 10E of the terminal accommodating chamber 100 (FIG. 2B) to the distal end 11S of the lance 11 is equal to the length from the distal end 21S of the box part 21 to the locking end 21K of the back end.

The joint 22 is a trough-shaped body with a semicircular shape in cross section view, and is a member for joining the box part 21 to the electric wire crimp part 23. The lance 11 returning to a normal state enters a space part present in the upper portion of the joint 22.

The electric wire crimp part 23 includes a crimp piece, and electrical connection between the electric wire crimp part 23 and an electric wire of a coated electric wire W is completed by crimping multiple core wires in the center of the coated electric wire W with the crimp piece.

In addition, in the drawing, the electric wire crimp part 23 is drawn conceptually since the individual core wires and the crimp part are not essential for the invention.

FIG. 1D is a perspective view of the removal jig 30. The removal jig 30 includes an insertion part 31 having a taper 31T in the distal end, and a grip part 32 formed integrally to the root of the insertion part 31.

The length from the root of the insertion part 31 to a start part (thick width part) of the taper 31T is the length from the entrance of the terminal accommodating chamber 10C to passage of the unlocking protrusion 13, and the width of the insertion part 31 is narrower than the width of the removal jig insertion space 10G between the right side wall of the right lance 11 and the right side surface 10R of the housing body 10H. The height of the insertion part 31 is the height in which the lance 11 disengages from the terminal 20 by lifting the unlocking protrusion 13.

Next, a process of inserting the terminal 20 into the terminal accommodating chamber 10C of the connector housing 10 will be described using FIGS. 3A to 4C.

Figure 3A:
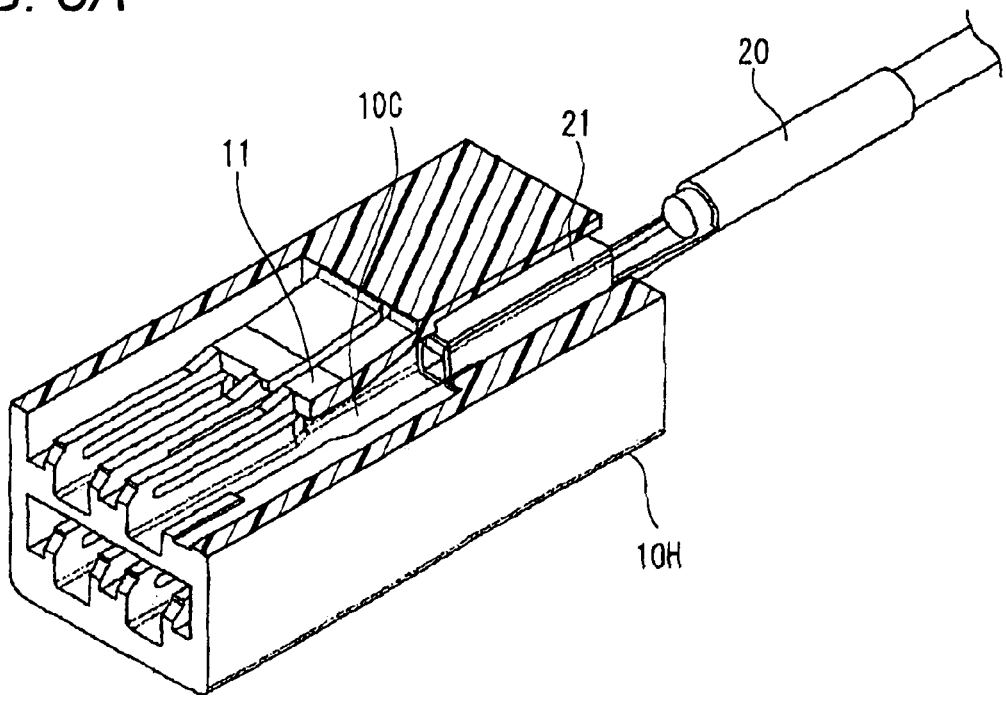
FIG. 3A is a transverse sectional perspective view showing a process of inserting the terminal into the connector housing of FIG. 1A, in a state just after insertion.
Figure 4A:
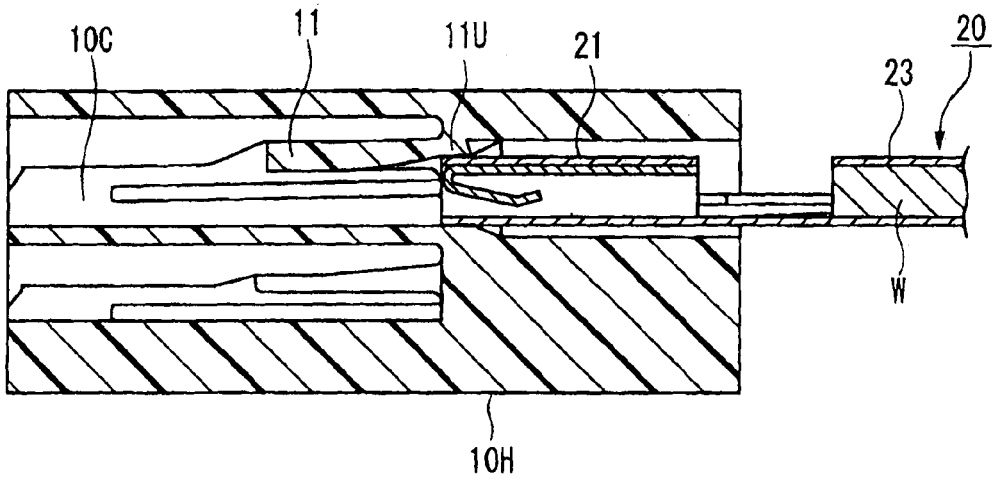
FIG. 4A is a sectional view showing a process of inserting the terminal into the connector housing of FIG. 1A, in a state just after insertion.

FIGS. 3A and 4A are a transverse sectional perspective view and a longitudinal sectional view just after insertion.

When the box part 21 of the terminal 20 is inserted from the back of the terminal accommodating chamber 10C of the housing body 10H and advances, the box part 21 abuts on the vicinity of the overhanging part 11U of the lance 11. At this time, the lance 11 remains a normal state.

Figure 3B:
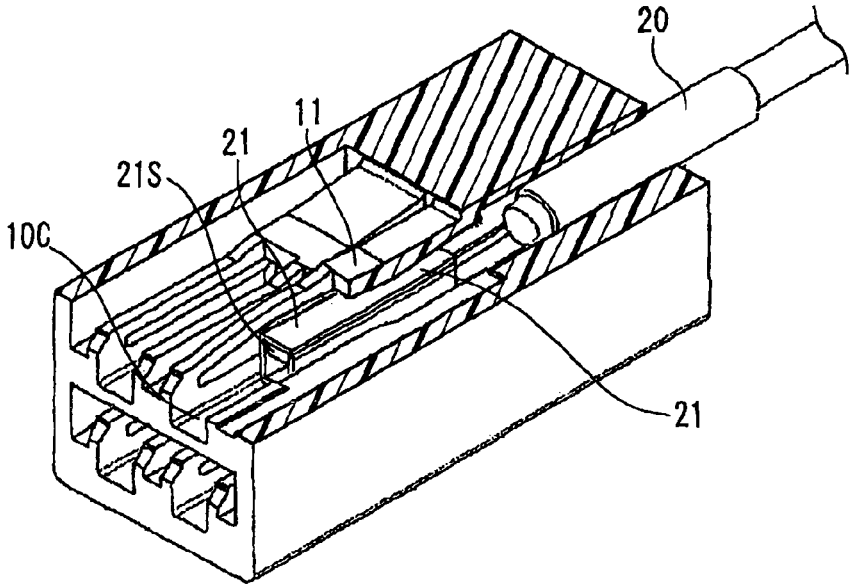
FIG. 3B is a transverse sectional perspective view showing a process of inserting the terminal into the connector housing of FIG. 1A, in a state of the middle of insertion.
Figure 4B:
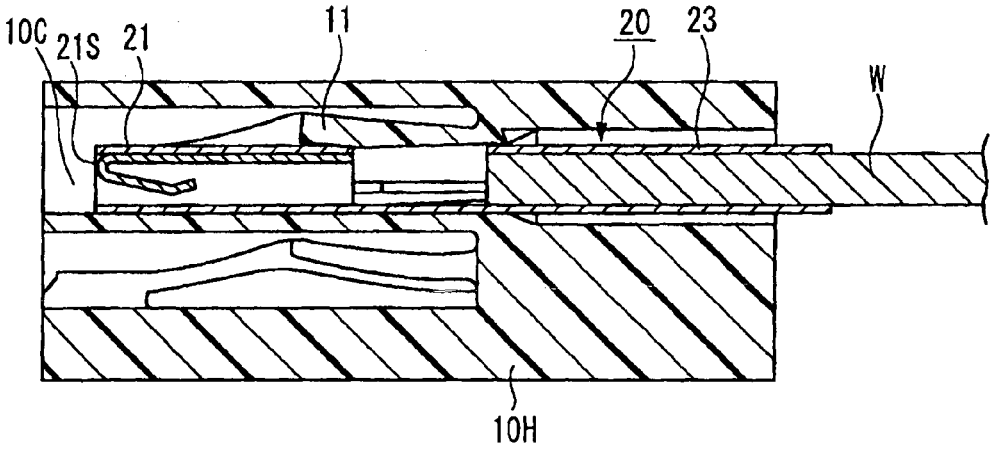
FIG. 4B is a sectional view showing a process of inserting the terminal into the connector housing of FIG. 1A, in a state just before the completion of insertion.

FIGS. 3B and 4B are a transverse sectional perspective view and a longitudinal sectional view in the middle of insertion.

The insertion of the terminal 20 advances further, and the distal end 21S of the box part 21 abuts on the lower portion of the lance 11 and upward pushes up the lance 11, and the lance 11 is retracted from the terminal accommodating chamber 10C to the side of the roof 10D, and the distal end 21S passes through the lower portion of the lance 11 (see FIG. 3B) and advances further, the lance 11 remains retracted even just before the completion of insertion (see FIG. 4B).

Figure 3C:
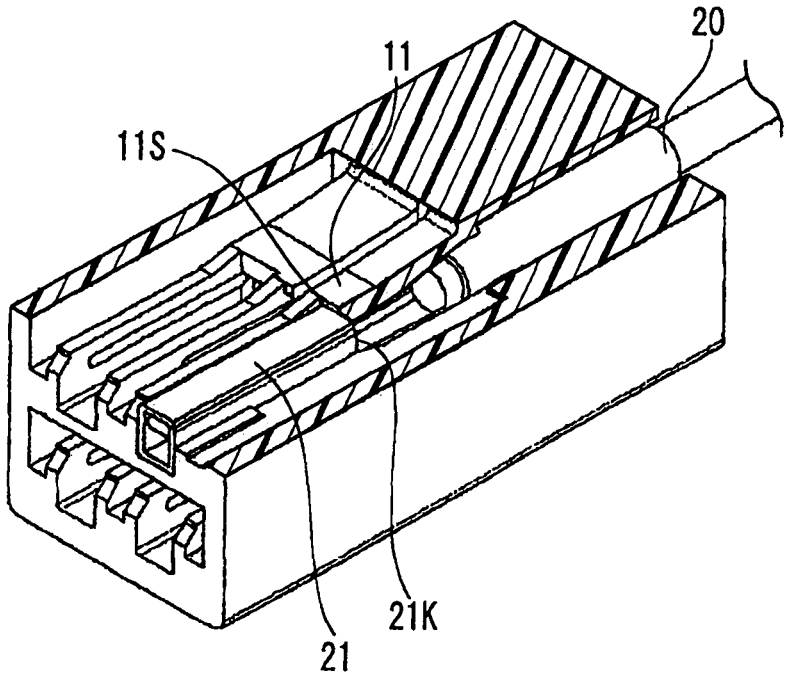
FIG. 3C is a transverse sectional perspective view showing a process of inserting the terminal into the connector housing of FIG. 1A, in a state of the completion of insertion.
Figure 4C:
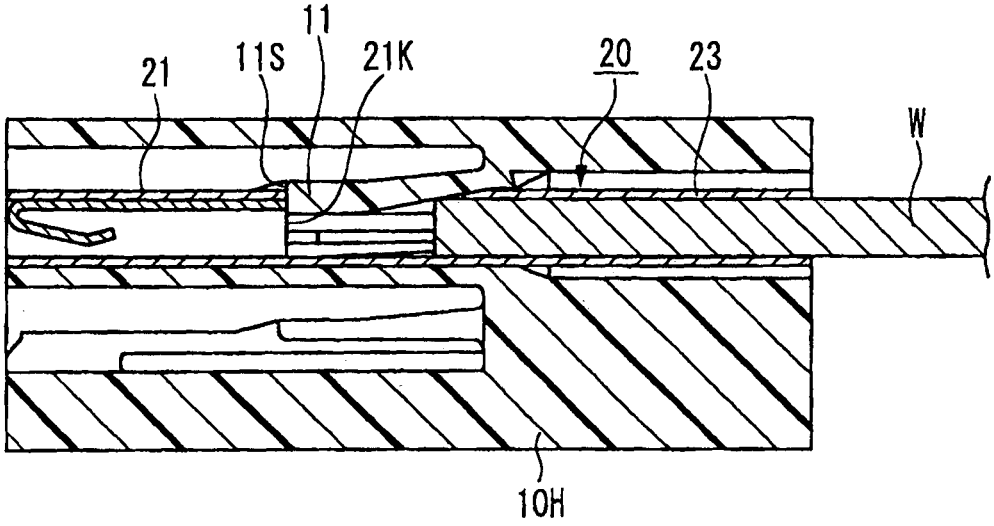
FIG. 4C is a sectional view showing a process of inserting the terminal into the connector housing of FIG. 1A, in a state of the completion of insertion.

FIGS. 3C and 4C are a transverse sectional perspective view and a longitudinal sectional view of the completion of insertion.

At the moment that the locking end 21K of the back end of the box part 21 of the terminal 20 passes through the distal end 113 of the lance 11, the lance 11 returns to the original position by an elastic force (reaction force) of a resin material, and the distal end 11S of the lance 11 engages with the locking end 21K of the box part 21 of the terminal 20 to complete the insertion. Thereafter, the terminal 20 is prevented from coming out of the housing body 10H.

Next, a process of smoothly removing the terminal 20 prevented from coming out of the housing body 10H will be described using FIGS. 5A and 6A.

Figure 5A:
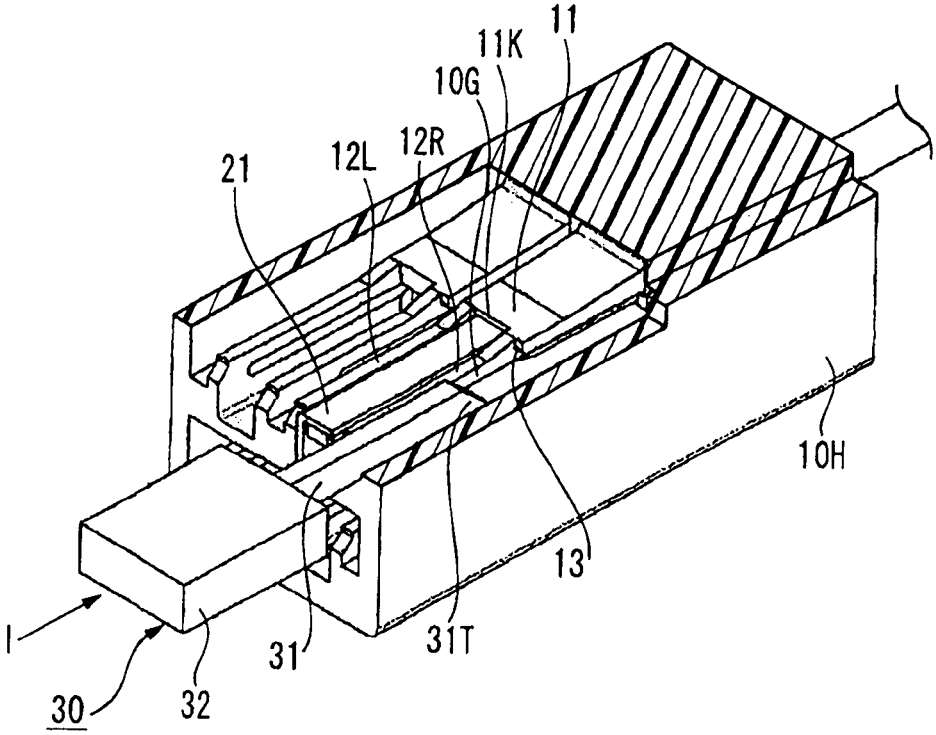
FIG. 5A is a transverse sectional perspective view showing a process of inserting the removal jig in order to remove the terminal inserted into the connector housing from the connector housing, in a state just after insertion of the removal jig.
Figure 5B:
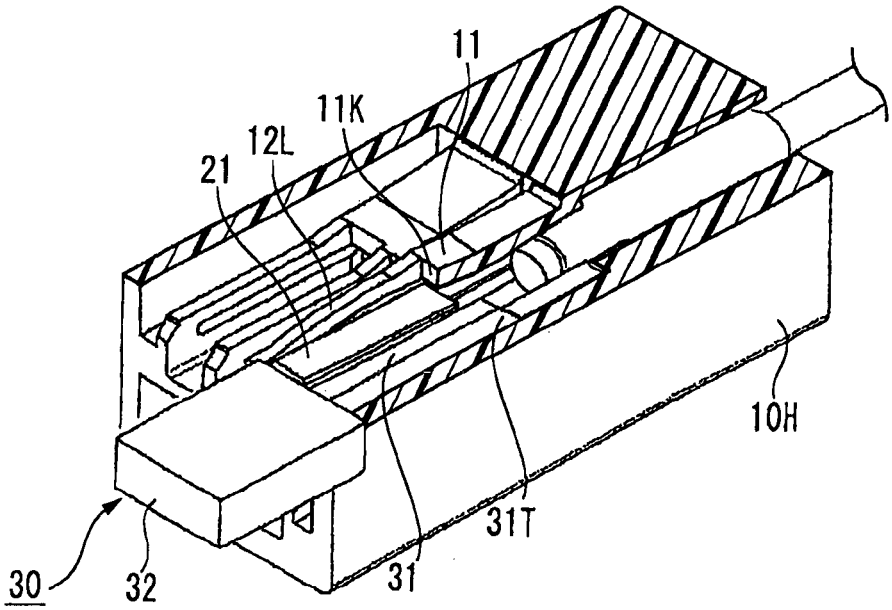
FIG. 5B is a transverse sectional perspective view showing a process of inserting the removal jig in order to remove the terminal inserted into the connector housing from the connector housing, in a state of the completion of insertion of the removal jig.
Figure 5C:
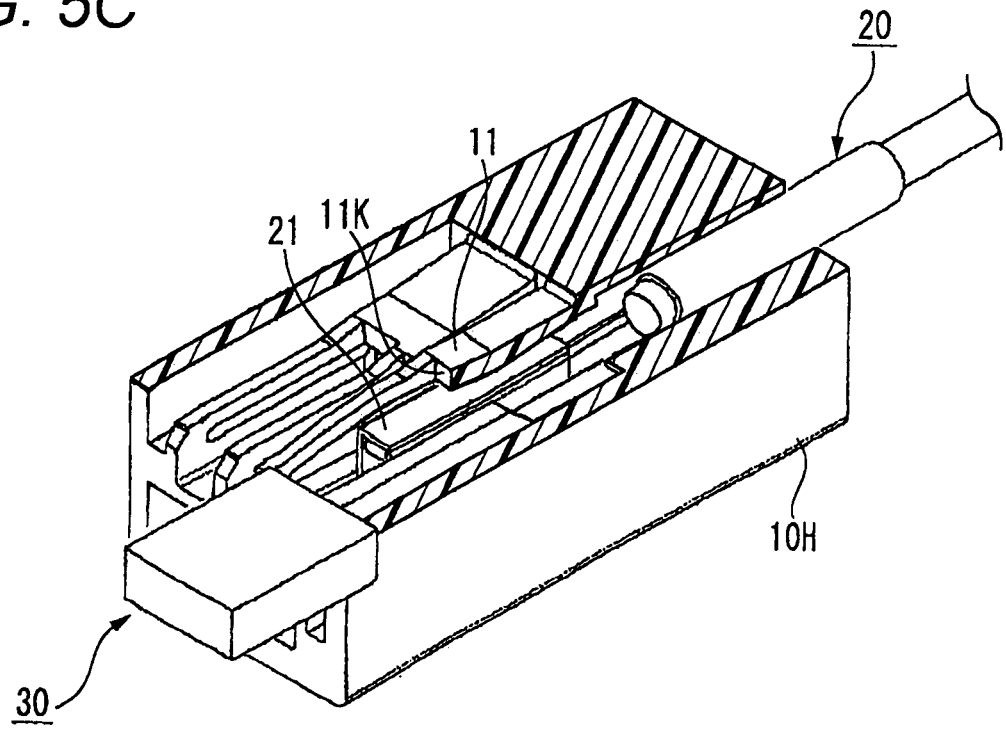
FIG. 5C is a transverse sectional perspective view showing a process of inserting the removal jig in order to remove the terminal inserted into the connector housing from the connector housing, in a state just after the terminal starts to be removed.
Figure 6A:
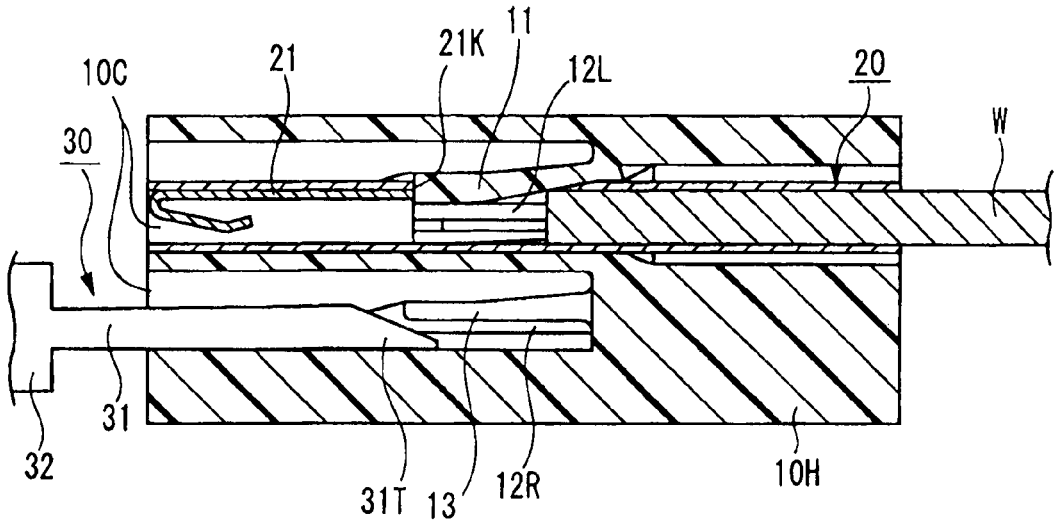
FIG. 6A is a sectional view showing a process of inserting the removal jig in order to remove the terminal inserted into the connector housing from the connector housing, in a state just after insertion of the removal jig.

FIGS. 5A and 6A are a transverse sectional perspective view and a longitudinal sectional view just after insertion of the removal jig 30. In addition, FIG. 6A is the view in which the removal jig 30 is inserted into the first-floor terminal accommodating chamber 10C of each of the housing bodies 10H of FIG. 2B, and the housing body 10H is the sectional view taken on arrow line A-A of FIG. 2A. Therefore, in FIG. 5, the removal jig 30 is inserted into the second-floor terminal accommodating chamber 100 of the housing body 10H in a direction indicated by an arrow I, but the removal jig 30 is not represented in the second-floor terminal accommodating chamber 10C of the housing body 10H of FIG. 6A (since FIG. 6A is the longitudinal sectional view through the lance 11). Hence, in order to associate an operation of the terminal 20 and the lance 11 of the second-floor terminal accommodating chamber 10C with an operation of the unlocking protrusion 13 and the removal jig 30 and represent the operations, FIG. 6A depicts the view in which the removal jig 30 is inserted into the first-floor terminal accommodating chamber 10C, and the second-floor terminal accommodating chamber 100 shows how to operate the arm 12, the terminal 20, the lance 11 on the far side of the unlocking protrusion 13 and the removal jig 30 when the first-floor removal jig 30 is inserted into the removal jig insertion space 10G and lifts the unlocking protrusion 13. That is, the operation of the second-floor removal jig 30 is represented on the first floor, and the operation of the second-floor lance is represented as it is on the second floor.

Now, when the insertion part 31 of the removal jig 30 is inserted into the removal jig insertion space 10G formed beside the second-floor terminal accommodating chamber 100 of the housing body 10H with the tip of taper 31T turned downward, the insertion part 31 of the removal jig 30 does not make contact with the unlocking protrusion 13 yet just after insertion, so that the lance 11 of the second-floor terminal accommodating chamber 100 remains engaging with the locking end 21K of the box part 21 of the terminal 20, and detachment prevention functions still.

Figure 6B:
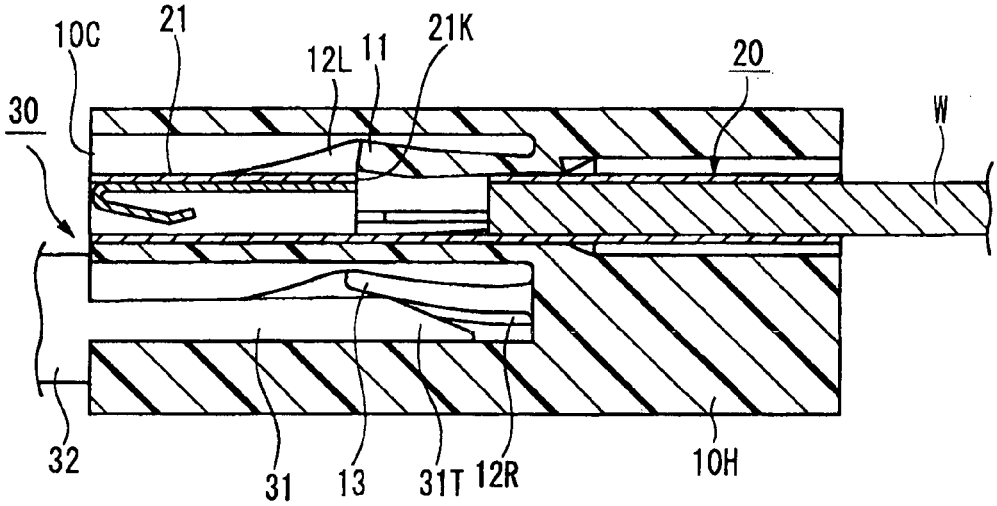
FIG. 6B is a sectional view showing a process of inserting the removal jig in order to remove the terminal inserted into the connector housing from the connector housing, in a state of the completion of insertion of the removal jig.

FIGS. 5B and 6B are a transverse sectional perspective view and a longitudinal sectional view of the completion of insertion of the removal jig 30. When the insertion of the second-floor removal jig 30 advances further and is completed, the unlocking protrusion 13 is lifted upward and the right arm 12R (see the second-floor terminal accommodating chamber) integrated with this unlocking protrusion 13 is also deformed and lifted and then, it is formed so that a reaction force of the left arm 12L becomes weaker than a reaction force of the right arm 12R, so that the left arm 12L follows deformation of the right arm 12R and is deformed similarly, with the result that the lance 11 is lifted upward in a horizontal state. Consequently, the terminal 20 can be removed from the terminal accommodating chamber 10C.

Figure 6C:
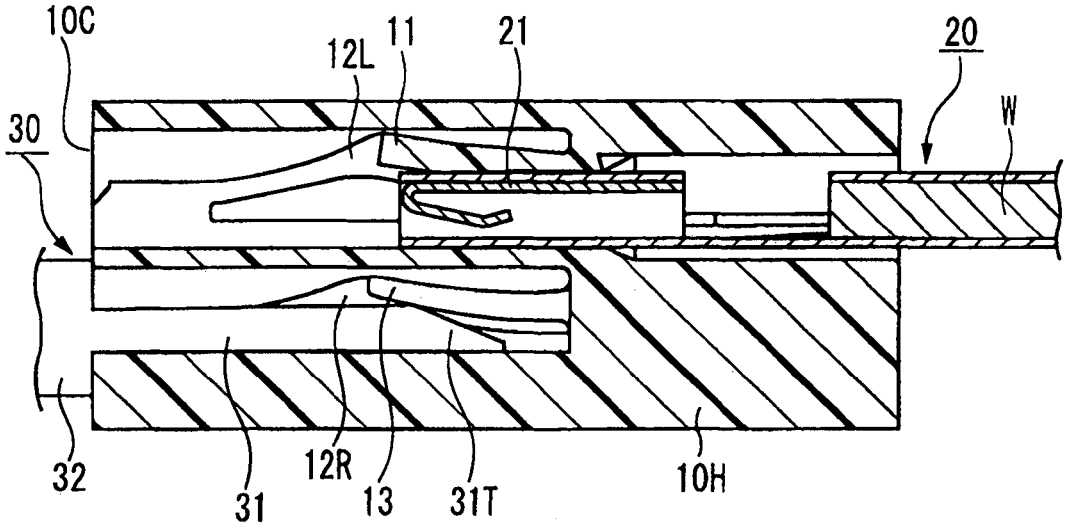
FIG. 6C is a sectional view showing a process of inserting the removal jig in order to remove the terminal inserted into the connector housing from the connector housing, in a state just after the terminal starts to be removed.

FIGS. 5C and 6C are a transverse sectional perspective view and a longitudinal sectional view of the completion of insertion of the removal jig 30. The lance 11 is lifted upward in the horizontal state and thereby, the lance 11 retracts from the terminal accommodating chamber 100 to the side of the roof 10D, so that the box part 21 of the terminal 20 passes through the lower portion of the lance 11 and can be removed from the terminal accommodating chamber 10C to the outside of the housing body 10H.

According to the invention thus, the lance is formed in fixed ended, so that a locking force of the terminal can be increased.

One of the unlocking protrusions formed in both sides of the lance is eliminated, so that the invention has a pitch narrower than that of a conventional product and miniaturization of the connector advances.

A reaction force of one of the right and left arms of both sides of the lance is weakened, so that the lance can be horizontally lifted in good balance even for only one unlocking protrusion.

The removal jig has a very simple shape, so that the robust removal jig is obtained at low cost.

In conclusion, the present invention made by the present inventors has been described in detail on the basis of the above-mentioned embodiment. However, the present invention is not limited to the above-mentioned embodiment, and can be variously modified without departing from the subject matter of the invention.

The present application is based on Japanese Patent Application No. 2011-075927 filed on Mar. 30, 2011, the contents of which are incorporated herein by way of reference.

INDUSTRIAL APPLICABILITY

The present invention is useful for providing a connector housing capable of increasing a lance locking force and having a cavity shape capable of holding even at a narrow pitch.

REFERENCE SIGNS LIST

10 CONNECTOR HOUSING
10C TERMINAL ACCOMMODATING CHAMBER
10D ROOF
10E ENTRANCE
10F BOTTOM
10H HOUSING BODY
11 LANCE
11S DISTAL END OF LANCE
11U OVERHANGING PART
12H LONG HOLE
12L LEFT ARM
12R RIGHT ARM
13 UNLOCKING PROTRUSION

20 TERMINAL
21 BOX PART
21C ELECTRICAL CONTACT PIECE
21K LOCKING END
21S DISTAL END OF BOX PART
22 JOINT
23 ELECTRIC WIRE CRIMP PART
30 REMOVAL JIG
31T TAPER
31 INSERTION PART
32 GRIP PART

The invention claimed is:

1. A connector housing, comprising:

a terminal accommodating chamber, formed with an opening configured such that a terminal is inserted therethrough;

a lance, extending from a top wall of the terminal accommodating chamber toward the opening in an extending direction; and a pair of arms formed of opposing sidewalls, respectively formed integrally to both lateral side surfaces of the lance, extending in the extending direction, and connected to a bottom wall of the terminal accommodating chamber, the pair of arms configured to deflect due to deflection of the lance, wherein an unlocking protrusion is formed in one of the arms, and wherein at least one dimension of a length, a thickness, and a width of one of the arms having an elongated hole is different from the other one of the arms having an elongated hole, so that, when a removable jig is inserted into an insertion space of the housing, a reaction force due to the deflection of the one of the arms which is provided with the unlocking protrusion is stronger than a reaction force due to the deflection of the other one of the arms.

2. The removal jig for removing the terminal inserted into the connector housing according to claim 1, comprising:

an insertion part having a length ranging from the opening to the unlocking protrusion; and a grip part coupled integrally to the insertion part.

3. A connector housing, comprising:

a terminal accommodating chamber comprising a top wall, a bottom wall, and a pair of opposing sidewalls, the terminal accommodating chamber configured to receive an electrical terminal;

a lance, extending obliquely from the top wall of the terminal accommodating chamber;

a first arm portion and a second arm portion of the respective opposing sidewalls, the first and second arm portions being portions of the opposing sidewalls above a pair of elongate holes in the opposing sidewalls, the arm portions being attached to the lance;

an unlocking protrusion formed on one of the first and second arm portions, wherein the lance, the first arm portion, and the second arm portion are configured to deflect in a direction orthogonal to the top wall for insertion of the electrical terminal, wherein at least one dimension of a length, a thickness, and a width of the first arm portion is different from the second arm portion.

4. The connector housing of claim 3, wherein the first and second arm portions of the opposing sidewalls extend farther forward towards an opening of the connector housing than the lance.

5. The connector housing of claim 3, wherein the first and second arm portions and the lance are integrally formed.

6. The connector housing of claim 3, wherein the opposing sidewalls are orthogonal to the lance.

7. The connector housing of claim 3, wherein the unlocking protrusion is formed on an outer surface, opposite an inner surface forming part of the terminal accommodating chamber, of one of the first and second arm portions.

* * * * *